US011047141B2

(12) United States Patent
Cheddie

(10) Patent No.: US 11,047,141 B2
(45) Date of Patent: Jun. 29, 2021

(54) SAFETY DEVICE

(71) Applicant: Daniel Cheddie, Turnford (GB)

(72) Inventor: Daniel Cheddie, Turnford (GB)

( * ) Notice: Subject to any disclaimer, the term of this patent is extended or adjusted under 35 U.S.C. 154(b) by 0 days.

(21) Appl. No.: 14/367,114

(22) PCT Filed: Dec. 17, 2012

(86) PCT No.: PCT/GB2012/053166

§ 371 (c)(1),
(2) Date: Jun. 19, 2014

(87) PCT Pub. No.: WO2013/093442

PCT Pub. Date: Jun. 27, 2013

(65) Prior Publication Data

US 2015/0096833 A1 Apr. 9, 2015

(30) Foreign Application Priority Data

Dec. 19, 2011 (GB) ..... 1121787
Nov. 2, 2012 (GB) ..... 1219798

(51) Int. Cl.
*E04G 5/04* (2006.01)
*E04G 1/38* (2006.01)
(Continued)

(52) U.S. Cl.
CPC ..... *E04G 1/38* (2013.01); *A62B 35/0037* (2013.01); *E04G 5/001* (2013.01); *E04G 5/046* (2013.01); *E04G 21/3276* (2013.01)

(58) Field of Classification Search
CPC ..... E04G 5/04; E04G 21/3261; E04G 21/32; E04G 21/3276; A47L 3/02
See application file for complete search history.

(56) References Cited

U.S. PATENT DOCUMENTS 529,745 A * 11/1894 McIntyre et al. ..... 182/87
3,058,542 A * 10/1962 Rogalla ..... E04G 3/26 182/45

(Continued)

FOREIGN PATENT DOCUMENTS

GB 2357112 6/2001
GB 2454596 5/2009

OTHER PUBLICATIONS

WIPO; Notification of Transmittal of the International Search Report and The Written Opinion of the International Searching Authority, or the Declaration; International Search Report; The Written Opinion of the International Searching Authority; dated May 2, 2013; pp. 1-11.

*Primary Examiner* — Alvin C Chin-Shue
(74) *Attorney, Agent, or Firm* — BakerHostetler

(57) ABSTRACT

A free-standing demountable window safety assembly adapted to rest, in use, on the floor inside a room containing a window opening in a wall, and against the wall containing the window, without engaging with the window opening, said assembly comprising: —•(i) at least two feet (125, 126) adapted to engage with the room floor•(ii) at least two arms (121A, 121B, 135A, 135B) adapted to engage with the room wall adjacent to but spaced away from the window opening; •(iii) at least two side portions (125, 123A, 135A, 133A) each supporting an arm; •(iv) at least one linking member (111A, 111C) adapted to link opposing side portions or opposing feet in a substantially rigid fashion. The invention also includes methods of manufacturing and using such safety assemblies.

19 Claims, 10 Drawing Sheets

(51) Int. Cl.

| | |
|---|---|
| ***E04G 21/32*** | (2006.01) |
| ***A62B 35/00*** | (2006.01) |
| ***E04G 5/00*** | (2006.01) |

(56) References Cited

U.S. PATENT DOCUMENTS 3,456,757 A * 7/1969 Sain ..... E06C 7/46 182/111
3,656,580 A * 4/1972 Gostling ..... 182/82
3,679,026 A * 7/1972 Hansen et al. ..... 182/132
4,078,633 A 3/1978 Fahy
4,538,704 A * 9/1985 Forrest ..... A62B 1/02 182/10
4,826,122 A * 5/1989 Cupp ..... E04G 3/26 182/111
5,101,935 A * 4/1992 LaBianca ..... 182/236
5,203,426 A * 4/1993 Sydnor ..... 182/57
5,718,305 A * 2/1998 Palmer ..... 182/45
5,931,259 A * 8/1999 Hoey ..... 182/107
5,954,157 A * 9/1999 Grimes ..... E06C 1/12 16/329
6,073,726 A * 6/2000 McCrystal ..... E06C 1/12 182/195
6,477,972 B2 * 11/2002 Perkins ..... E02D 29/12 114/201 R
6,540,301 B1 * 4/2003 Bottoms ..... A47C 9/025 135/65
6,880,675 B2 * 4/2005 Huang ..... E06C 1/18 182/166
6,945,606 B2 * 9/2005 Ponticelli ..... A47C 1/023 297/337
6,983,824 B1 * 1/2006 Dandurand ..... 182/82
8,539,889 B1 * 9/2013 Khalaf Allah ..... A47B 85/06 108/115
2006/0169535 A1 * 8/2006 Phillips ..... E06C 1/39 182/119
2006/0272899 A1 * 12/2006 Chang ..... E06C 7/44 182/201
2008/0078616 A1 * 4/2008 Ursitti ..... E06C 7/44 182/201
2010/0012427 A1 1/2010 Julliard
2012/0211303 A1 * 8/2012 Parquette ..... 182/45

* cited by examiner

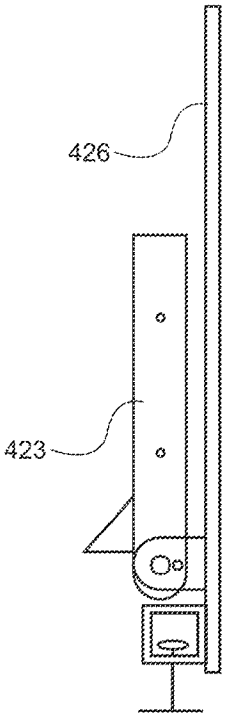
FIG. 7C
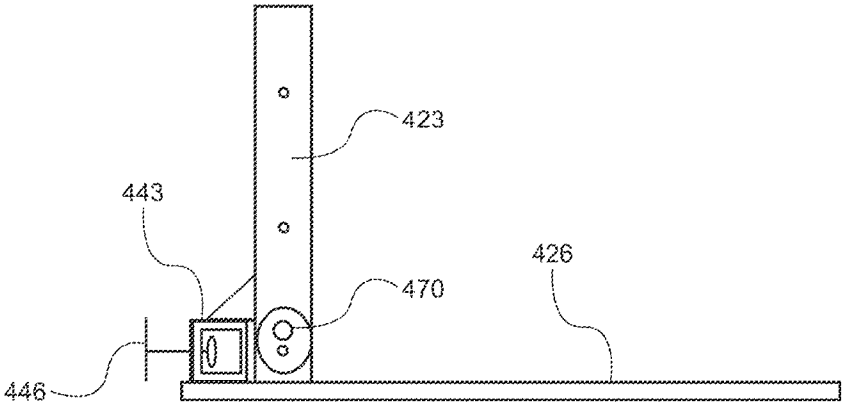
FIG. 7B
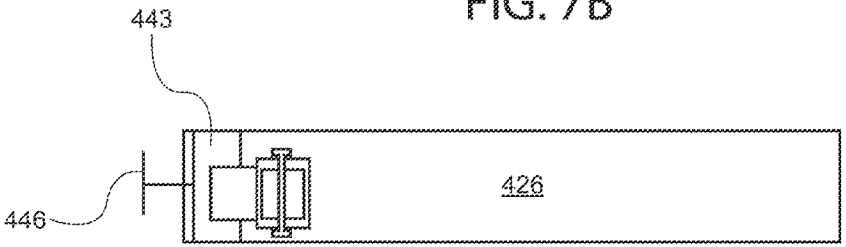
FIG. 7A
FIG. 7

SAFETY DEVICE

FIELD OF THE INVENTION

The present invention relates to safety devices and apparatus and to a method of keeping a workman safe. It is particularly applicable, but in no way limited, to safety devices and methods for use by workmen who need to perform an operation on or near an upstairs window in safety, and to harness heavy window units during removal and/or installation.

BACKGROUND TO THE INVENTION

The installation, replacement or refurbishment of upstairs windows can be a dangerous operation, especially when the internal window sill is low, as in some Georgian and Victorian houses. The risks of working at height are well known yet falls remain the most common cause of death and injury in the construction industry. Replacement double or triple glazed units can be extremely heavy. It is therefore essential that any work carried out at height must be properly planned, and for equipment such as guard rails, barriers or harnesses to be used where appropriate.

In the case of replacing windows on the first floor or above, it is a Health and Safety requirement under the HSE Work at Height Regulations 2005 (as amended) that the Duty Holder must:—

1—Avoid work at height where they can

2—Use work equipment or other measures to prevent falls where they cannot avoid working at height; and 3—Where they cannot eliminate the risk of a fall, use work equipment or other measures to minimise the distance and consequences of a fall should one occur.

It follows therefore that in many situations the duty holders must use/supply work equipment or other measures to prevent falls where they cannot avoid work at height. Companies tend to favour scaffold or a system with a harness. Scaffold can be very expensive and time consuming to erect and dismantle and using a harness system presents a problem as to where the harness can be safely anchored. Domestic properties rarely have an eye bolt over a window, so this is generally not an option. Safety bars that attach to the span of a doorway are known for attaching a harness, but these are far from ideal. Their use relies upon having an inward opening door substantially opposite the window. Even if such a door is available, with suitable structural strength, the trailing wire, safety rope or chain reaching from the door to the window presents a dangerous tripping hazard for anyone in the room. Anyone else in the room other than the anchored worker(s) is also unsafe.

Safety devices that temporarily fix to a window aperture are known from GB2,102,858 (Makwana). This device expands to fit between the structural members of the building defining the window opening. However, the feet of the device are designed to engage with the window frame. This in itself prevents removal of the window frame and thus cannot be used when windows are being replaced.

A second type of window safety bracket is described in US2009/0188174 (Schreiber). This device consists of two parallel bars one which clamps inside and one which clamps outside of the window. Whilst this is a secure arrangement it once again prevents removal of the window or window components.

It is an object of the present invention to provide a safe, flexible, free-standing, demountable safety device for use when working on upstairs windows and which overcomes or at least mitigates the problems outlined above.

SUMMARY OF THE INVENTION

According to a first aspect of the present invention there is provided a free-standing demountable window safety assembly adapted to rest, in use, on the floor inside a room containing a window opening and against a wall containing the window without engaging with or passing through the window opening, said safety assembly comprising:

(i) at least two feet adapted to engage with the room floor;

(ii) at least two arms, the end of each arm being adapted to engage with the room wall adjacent to but away from the window opening;

(iii) at least two side portions, each supporting an arm and a foot;

(iv) at least one linking member adapted to link opposing side portions or opposing feet in a substantially rigid fashion.

By providing a demountable structure with two side portions, each with their own feet to sit on the floor and with an extending arm to rest on the wall either side of a window opening, together with linking members to connect together the two side portions in a spaced apart fashion, a safe and strong demountable structure can be quickly created to secure a worker's harness to, without contact with the window opening. Importantly, a workspace free from obstructions is created between the opposing side portions, the linking members and the window opening. This provides a safe and secure workspace for one or more workmen.

Preferably the side portions comprise a vertical-in-use portion and a horizontal-in-use portion, the horizontal-in-use portion supporting an arm and the vertical-in-use portion carrying a foot.

Preferably the vertical-in-use portions and the horizontal-in-use portions are telescopic. This enables the height and the depth of the safety assembly to be adjustable to suit the working conditions on a particular job.

Preferably the side portions further comprise a bracing member, bracing between the vertical-in-use portion and the horizontal-in-use portion.

Preferably the linking member(s) are telescopic, enabling the width of the safety assembly to be adjustable. This telescopic arrangement, in combination with the telescopic nature of the side portions means that a window safety assembly of any suitable height, width or depth can be created. This is particularly useful if the window is a very tall window or it is necessary to span obstructions in front of the window opening. Typical obstructions that are encountered from time to time include kitchen units.

Preferably the safety assembly further comprises a mounting means, wherein the mounting means is adapted to connect a safety harness to the safety assembly, and preferably the mounting means is associated with a linking member.

Preferably the mounting means is attached to a linking member.

Preferably the mounting means is mounted on a cord stretched between opposing side portions, the cord. A suitable cord is a rope lanyard such as a GRILLON® line available from Petzl International, 132 Rue du Pre Blanc, 38920 Crolles, FRANCE. This cord can be constructed of other materials, as selected by the materials specialist, depending on the loads to be taken.

Preferably two or more mounting means are provided, enabling two or more operatives to be independently attached to the safety assembly at one time.

Preferably the safety assembly further comprises a wall pad located substantially at the end of each arm, the wall pads being adapted to contact the wall adjacent to the window opening in use.

In a particularly preferred embodiment the wall pads are pivotally mounted with respect to an arm, enabling the safety assembly to engage with a room wall that is not perpendicular to the room floor.

Preferably the feet are elongate and project along the floor in the direction of the arm such that they support a side portion and an arm such that the side portion is free-standing. In a particularly preferred embodiment the feet are pivotally mounted with respect to their respective side portion. This pivotal arrangement simplifies storage and transportation of the safety assembly.

According to a further embodiment of the present invention there is provided a free-standing demountable window safety assembly adapted to rest, in use, on the floor inside a room containing a window opening and against a wall containing the window, without engaging with the window opening, said safety assembly comprising:

(a) at least two floor engaging members;
(b) at least two feet, one at the end of each floor engaging member;
(c) at least two wall engaging members;
(d) at least two wall pads, one at the end of each wall engaging member the wall pads being adapted to contact the wall adjacent to the window opening in use;
(e) at least one linking member adapted to link opposing floor engaging members; wherein a respective wall engaging member is connected to a respective floor engaging member, such that in use a foot engages with the base of the wall containing the window and a wall pad engages with the wall adjacent to the window opening.

Preferably a wall engaging member is pivotally connected to a respective floor engaging member.

Preferably the floor engaging members are telescopic, the wall engaging members are telescopic and the linking member(s) are telescopic.

Preferably the safety assembly further comprising a mounting means adapted to connect a safety harness to the safety assembly, and more preferably the mounting means is associated with a linking member.

Preferably the mounting means is attached to a linking member.

Preferably the wall pads are pivotally connected with respect to a wall engaging member, enabling the safety assembly to engage with sloping walls, sloping at a variety of angles to the perpendicular.

According to further embodiment of the present invention there is provided a method of manufacture of a free-standing demountable window safety assembly, said method comprising the steps of providing:

(i) at least two feet adapted to engage with the room floor;
(ii) at least two arms adapted to engage with the room wall adjacent to but spaced away from the window opening;
(iii) at least two side portions, each supporting an arm;
(iv) at least one linking member adapted to link opposing side portions or opposing feet in a substantially rigid fashion;

and subsequently providing those items as a self assembly kit.

According to further embodiment of the present invention there is provided a method of manufacture of a free-standing demountable window safety assembly, said method comprising the steps of providing:

(a) at least two legs or floor engaging members;
(b) at least two feet, one at the end of each floor engaging member;
(c) at least two arm or wall engaging members;
(d) at least two wall pads, one at the end of each wall engaging member the wall pads being adapted to contact the wall adjacent to the window opening in use;
(e) at least one linking member adapted to link opposing floor engaging members;
wherein a respective wall engaging member is connected to a respective floor engaging member, such that in use a foot engages with the base of the wall containing the window and a wall pad engages with the wall adjacent to the window opening;

and subsequently providing those items as a self assembly kit.

BRIEF DESCRIPTION OF THE DRAWINGS

Preferred embodiment of the present invention will now be described, by way of example only, with reference to the accompanying drawings wherein:

FIG. 7 illustrates side and plan views of a pivotal foot arrangement;

DESCRIPTION OF THE PREFERRED EMBODIMENTS

The present invention will now be described by way of examples only. These are not the only ways the invention may be put into practice, but they are the best ways currently known to the applicant.

Figure 1:
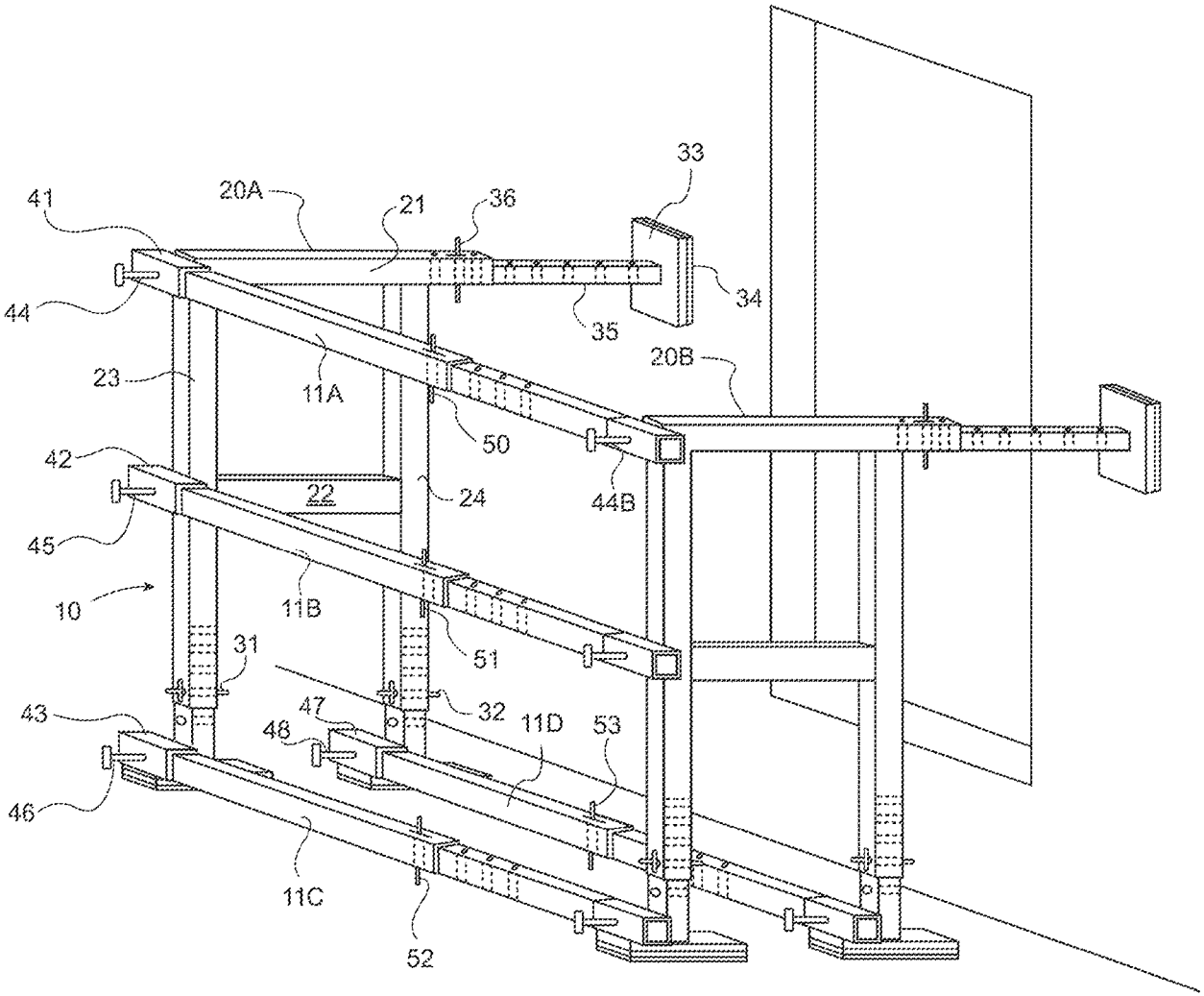
FIG. 1 illustrates a perspective view of an assembled window safety device according to a first embodiment positioned in use in front of a window aperture inside a room.

With reference to FIG. 1, this shows a demountable window safety assembly 10 in its assembled state. This assembly comprises two side portions or main frame units 20A and 20B, connected together by three linking members 11A, 11B and 11C. A side portion 20 is shown more clearly in FIG. 2.

Figure 2:
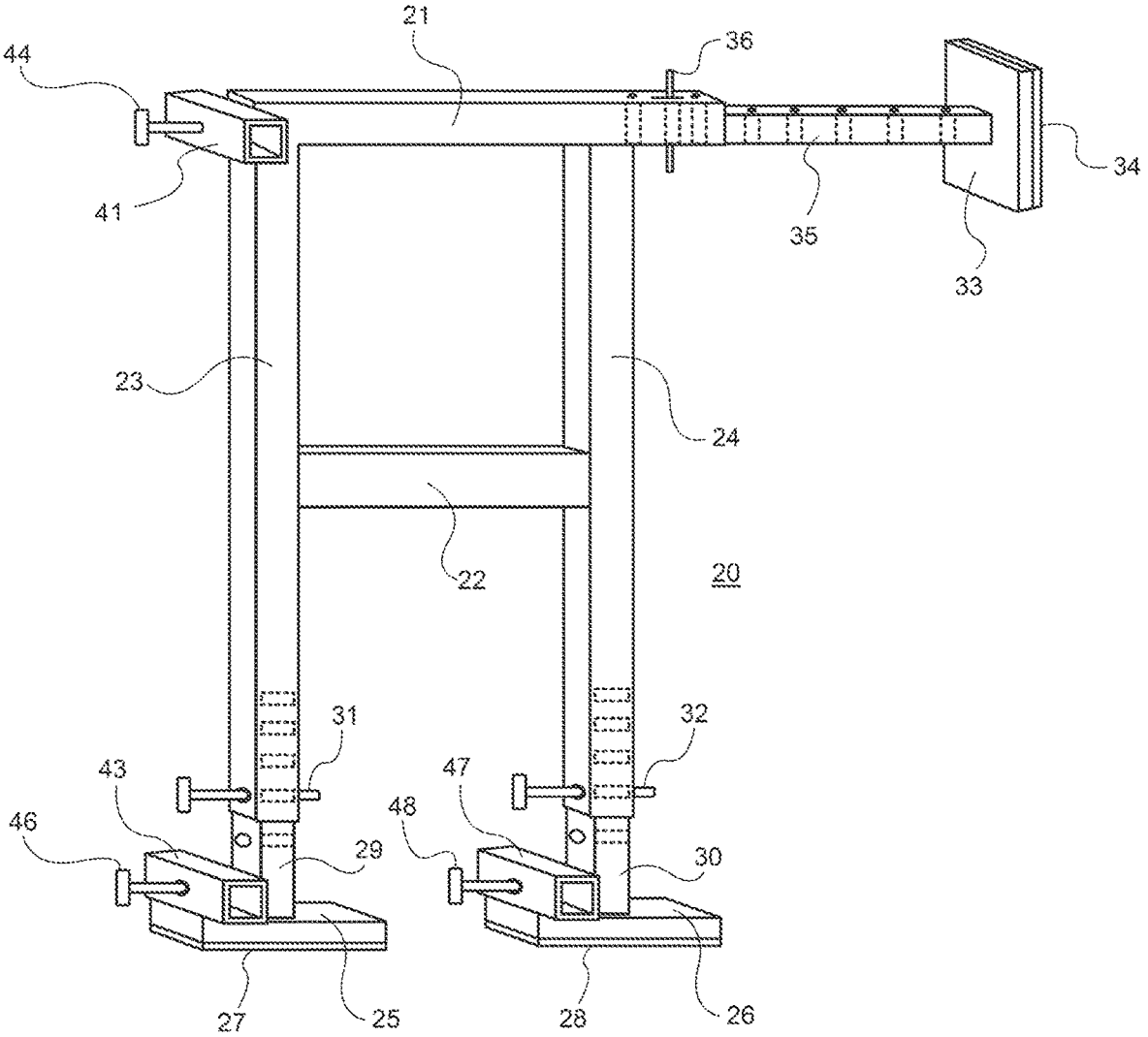
FIG. 2 illustrates one side portion of the window safety device shown in FIG. 1.

FIG. 2 shows a rigid main frame unit consisting of two upright members 23, 24, linked and fixed together by two cross-members 21 and 22. These are typically formed from box section tubing welded or otherwise fixed together in the shape shown. Two feet 25, 26 are attached to the bottom of the telescopic upright members 29, 30 respectively in a telescopically extendible fashion. The bottom of each foot is substantially covered by a non-slip, non-marking sole or floor pad 27, 28. The length-extendible upright members 29, 30 are held in place by positioning pins 31, 32 which pass through holes in the upright members 23, 24. These positioning pins can take a variety of forms as known in the art. They could be strong metal pins or bolts that engage with a threaded portion inside the box sections. By this mechanism the height of the window safety assembly can be adjusted to suit the height of the window being worked on.

In a similar fashion to the feet, an arm 35, extends away from the main frame or side portion substantially at right angles to the upright members 23, 24. At the end of the arm 35 there is a substantially flat, planar hand or wall pad 33, the face of which is substantially covered by a non-slip, non-marking pad 34. A positioning pin 36 serves to hold the arm 35 in place at the desired distance away from the upright 24.

Linking members 11A, 11B, 11C and 11D extend between the first and second main frame units and are held securely in place by box sections 41, 42, 43 and 47 and positioning screws 44, 45, 46. The box sections are welded to, bolted to, or otherwise firmly fixed to uprights 23 and 24 in appropriate locations. The positioning screws serve to clamp the linking members firmly and securely in place.

The linking members or rails 11A, 11B, 11C, 11D, are telescopic by virtue of two box sections sliding tightly one within another and held in place by pins 50, 51, 52, 53. Such telescopic arrangements are well known. It follows therefore that the window safety assembly is fully adjustable in both height and depth. This means that it can be used with any size of window. It sits squarely on the floor inside the room directly in front of the window opening where work is taking place, with the pads on the face of each arm resting on the wall, one each side of the window opening, and the floor pads resting squarely on the floor. This arrangement leaves the window opening completely unobstructed and provides a safe and secure workspace for one or more workmen within the safety assembly.

It will be noted that no part of the safety assembly engages with or passes through the window or the window opening. Also, the arms and wall pads engage the wall on either side of the window opening substantially below the level of the top of the window opening.

Figure 3:
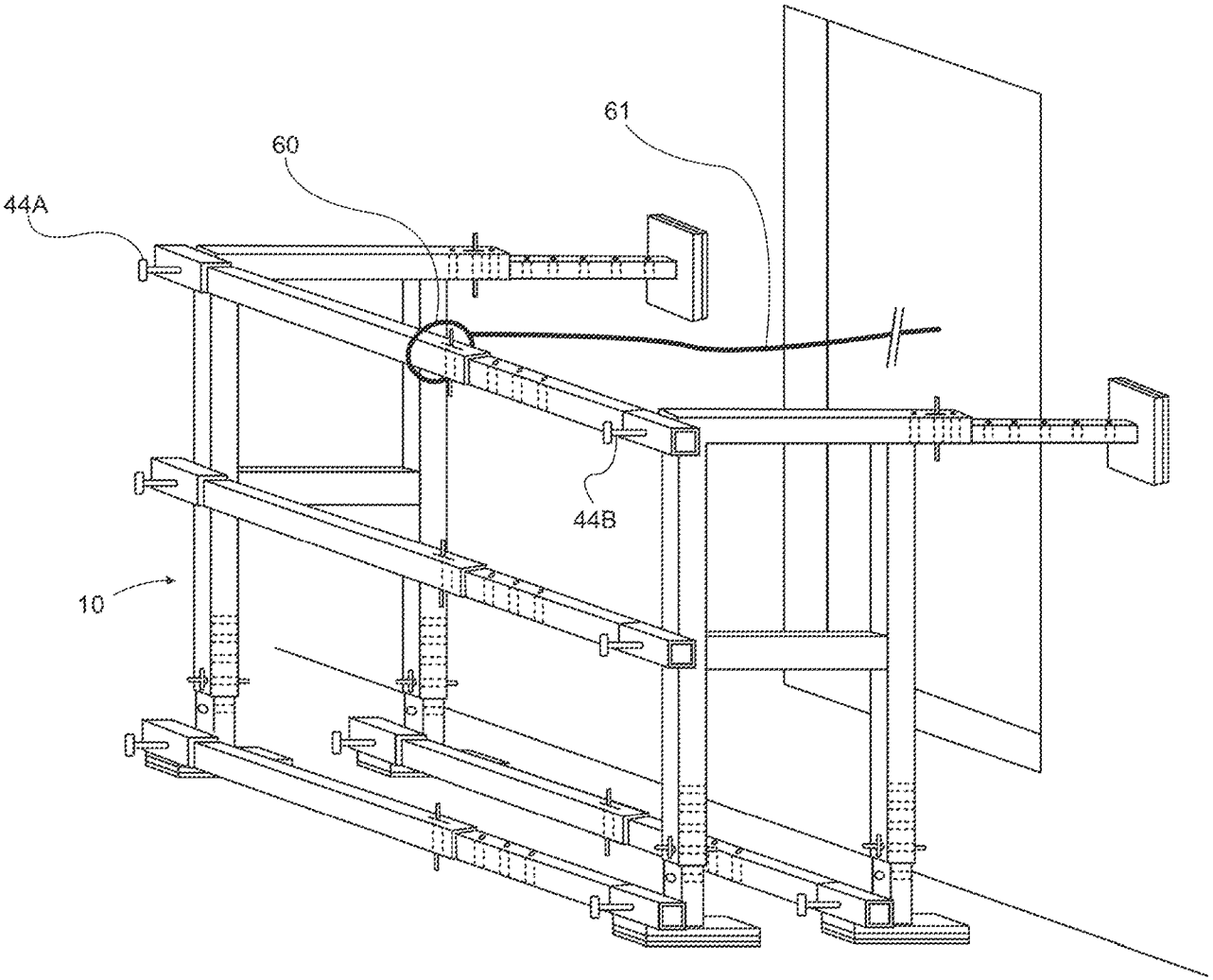
FIG. 3 illustrates the window safety device of FIG. 1 with a ring and extending strap for attaching to a safety harness attached to the top rail.

Referring to FIG. 3, this illustrates how a workman in a harness is attached to the window safety assembly. A ring 50 is threaded over one of the linking rails before the safety assembly is assembled. Alternatively, once the safety assembly is assembled, the linking rail may be unfixed at one end by undoing a positioning screw 44A or 44B and telescopically reduced in length such that the ring can be slid over the linking rail. The linking rail is then extended and fixed back in place.

The ring 60 may be coated in a rubber or plastics material in order to allow it to slide quietly and easily over the linking rail or member. A safety harness is then attached to the ring by way of conventional lanyard, 60 and MGO connector. Alternatively an MGO connector can be used over the linking rail in place of the ring 60.

In an alternative preferred embodiment the wall pads at the end of the arms 33, 35 may be articulated by way of, for example, a ball and socket joint (not shown).

Whereas the floor in a room is generally flat and horizontal, walls are not always flat and perpendicular. By articulating the wall pad at the end of the arm 35 it is possible to allow for and take account of any irregularities that may be present in the wall on either side of the window.

From the foregoing description it will be appreciated that the window safety assembly consists of two side portions, which may be substantially identical, and a plurality of linking members. These components can all be flat-packed for transport to site. The leg(s) and arm(s) on the side portions may be telescopically adjustable, as may be the linking member(s). A safety harness is then attached at an appropriate point on the safety assembly, generally to a linking member.

In terms of materials of construction, any suitable material as specified by the materials specialist can be used. Typically the safety assembly is made from a metal such as steel, aluminum or aluminum alloy. However, plastics, materials, especially reinforced plastics materials may be used providing they have sufficient load bearing strength.

Whilst the various box or tubular sections are shown as having a square cross-section, any suitable cross-section can be used, such as a circular cross section.

Figure 4:
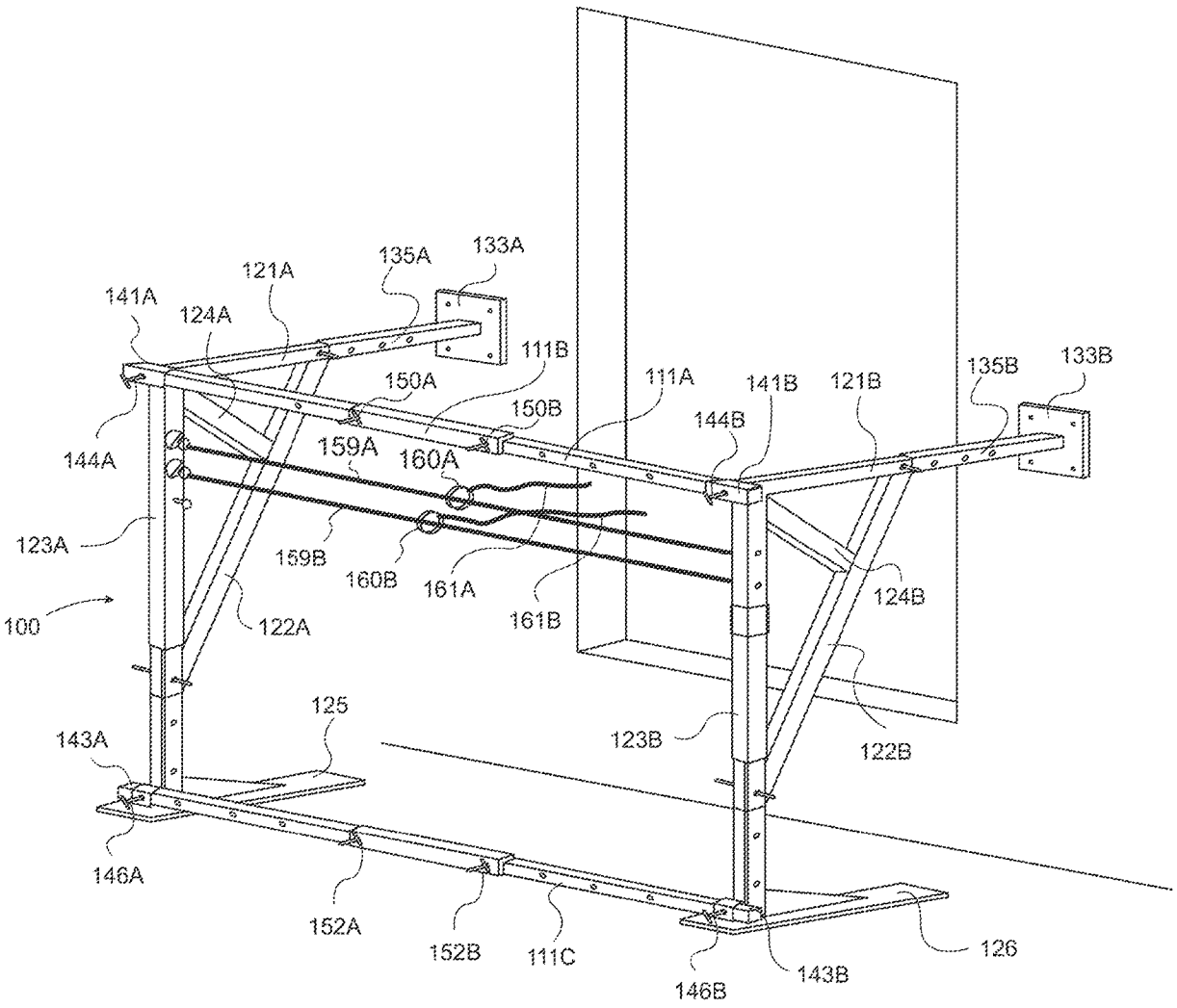
FIGS. 4 & 4A illustrates a perspective view of an assembled window safety device according to a second embodiment positioned in use in front of a window opening in a substantially vertical wall.

A further embodiment 100 is illustrated in FIG. 4, in which a similar numbering system has been adopted where possible to that used in FIG. 1. In this example large feet 125, 126 are provided which extend in the same direction as arms 121A, 135A, 121B, 135B such that the equivalent of a side portion described above is free standing. In this example a side portion consists of a foot 125, a leg 123A, an arm 121A, 135A and a wall pad 133A. Bracing members 122A, 124A, 122B, 124B extending between the arm and the leg elements to add both strength and rigidity to the construction of the side portion. The legs and the arms are both telescopically extendible in the same way as the version described above, such that both the height of the assembly and the distance of the intermediate member (see below) or the rear of the assembly from the window can be adjusted.

Two linking members 111A and 111C connect opposing side portions together in a substantially rigid fashion. The linking members are both telescopically extendible by means of pins or bolts 150A/150B, 152A/152B and outer members 111B and 111D. The linking members are held captive by short box sections 141A, 143A, 141B, 143B and pins/bolts 144A, 144B, 146A, 146B. The end result is a rigid but easily demountably safety frame assembly which can be adjusted to span a window of any common width. The wall pads 133A, 133B rest in use against the wall adjacent to but spaced away from the window opening and no part of the safety assembly engages with any part of the window opening or passes through the window opening. This leaves the window opening completely clear, allowing easy removal of an old window and/or installation of a new one.

As in the previous example, a safety harness is tethered to the safety assembly, in this example by way of rings 160A, 160B tethered to cords 159A, 159B stretched between opposite side portions. The cords could be made from high tensile strength rope, wire or chain, depending on the loads envisaged.

Figure 5:
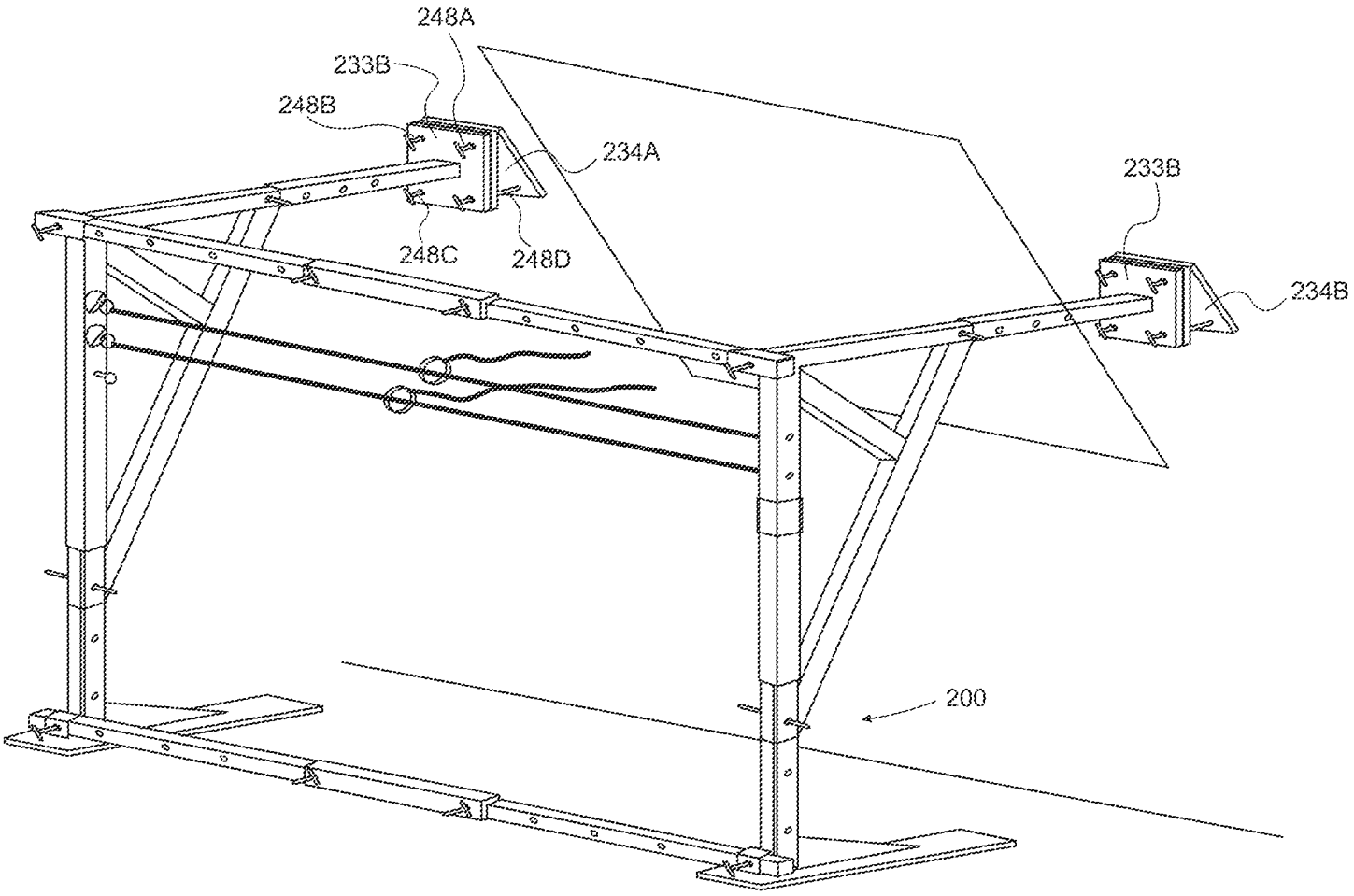
FIG. 5 illustrates a perspective view of an assembled window safety device according to a further embodiment positioned in front of a window opening in a sloping wall.

It will be noted that the cords shown in FIGS. 4 and 5 are mounted near the top of opposing legs, such that the harness mounting point is as high off the ground as possible, for added safety. It is desirable that this mounting point is always above waist height of the operative(s).

Figure 4A:
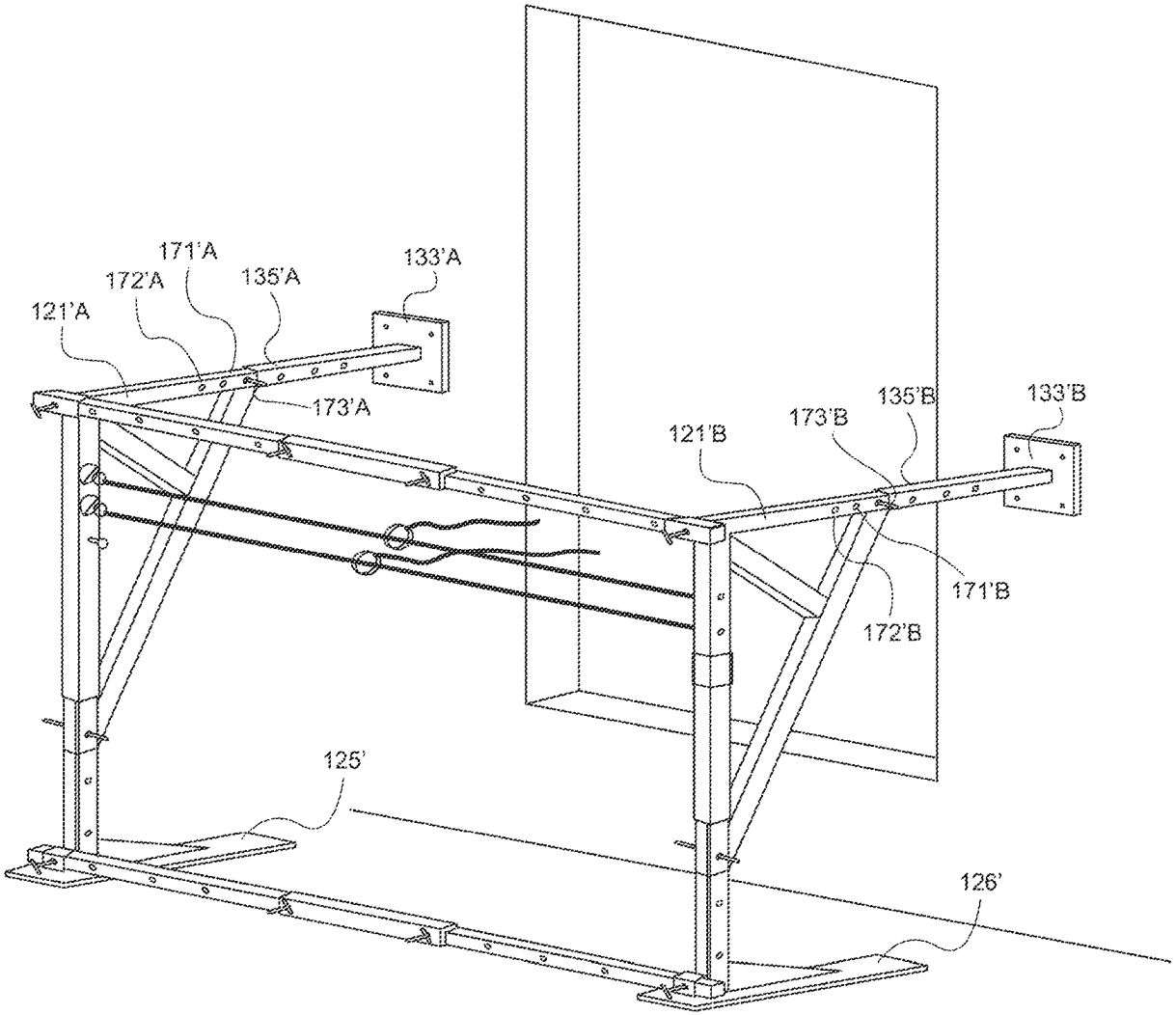

FIG. 4A illustrates how additional adjustability can be incorporated into the telescopic arms of the assembly. Additional fixing holes 171' A/B, 172' A/B and 173' A/B are provided in the static part of arms 121' A/B. This allows for fine adjustment of the length of each arm and allows for discrepancies in the wall on either side of the window. It could be for example that there are tiles on one side of the window. Or that the assembly must rest on an architrave present on one side of the window but not the other.

Having a series of holes in both parts of the telescopic arm, and having the holes in the one part spaced substantially closely together provides the desired flexibility.

FIG. 5 illustrates a similar arrangement to that shown in FIG. 4 in a safety assembly 200, except that the front faces 234A, 234B of the wall pads 223A, 223B are adjustable out of the vertical plane. This adjustability enables the safety assembly to be used where the widow wall is not perpendicular to the floor, but sloping at an angle. This is a particularly important feature because it is both difficult and expensive to erect scaffolding outside a window in a sloping roof. This type of safety assembly therefore offers a particularly cost effective alternative to scaffolding in that situation.

The angle adjustability can be achieved by pivotally mounting the front face of the wall pads with respect to the wall pad body along the upper or top edge of the body of the pad. Four securing bolts 248A, B, C and D secure the front of the wall pad at the desired angle. In this context the term 'pivotally mounted' has a broad meaning and is not limited to arrangements where there is a fixed pivot point. It extends to cover any arrangement in which the angle of the front face of the wall pad is adjustable.

A further safety feature, not shown in the Figures, is the use of one or more load restraint straps stretched between opposing side portions across the rear of the safety assembly. This not only adds strength to the assembly but prevents inadvertent access into the work space inside the safety assembly. These assemblies can be quite large when the legs, arms, and linking members are extended fully. Typically the width and height could be 1.9 meters, and the depth a similar dimension. It will be understood that by varying the length of the arms, legs and/or linking members any suitable size of safety assembly, within reason, could be constructed.

Figure 6:
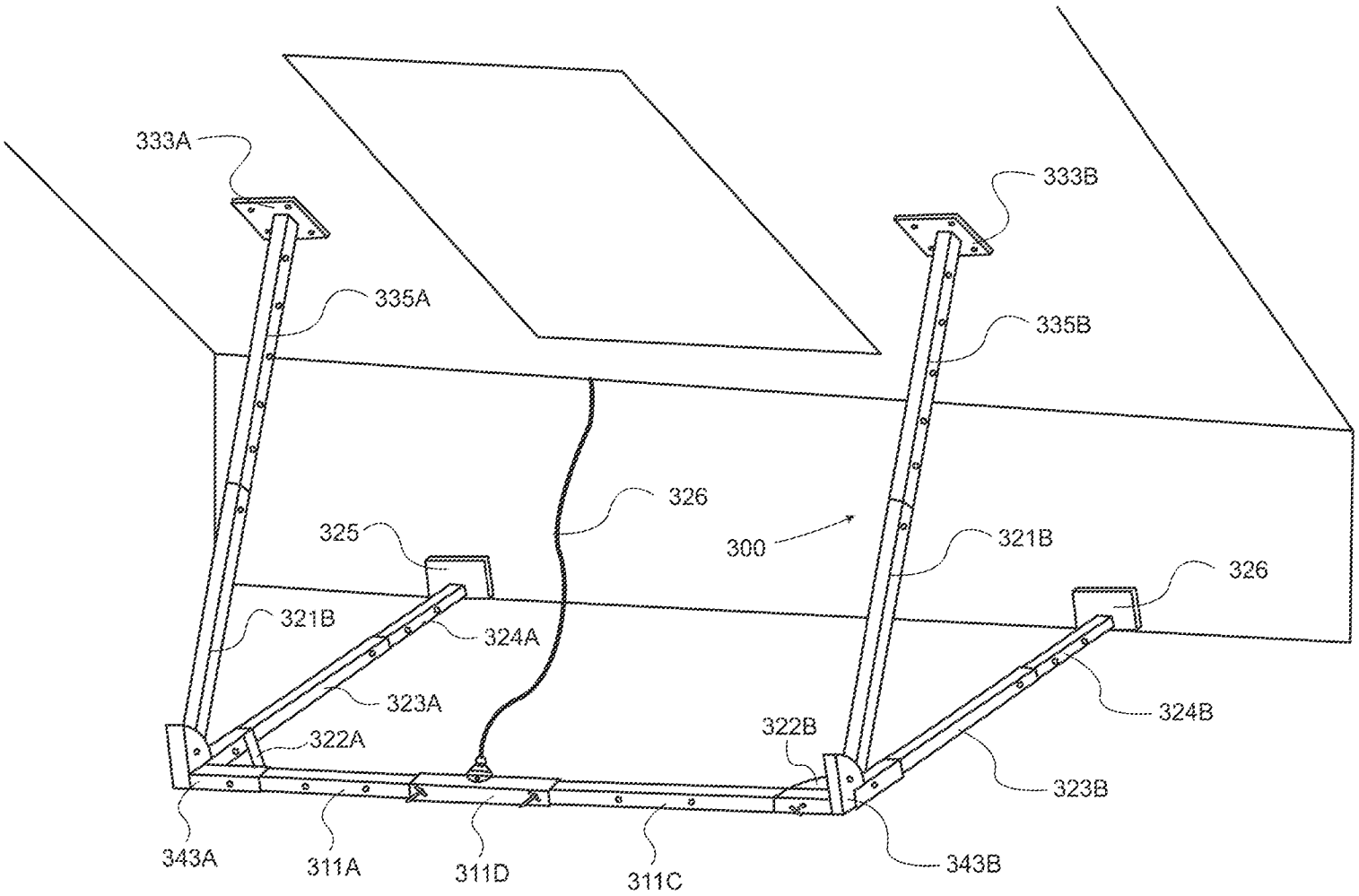
FIG. 6 illustrates a perspective view of an assembled window safety device according to a further embodiment positioned in front of a window opening in a sloping wall.

A further version of the present invention is illustrated in FIG. 6. This safety legs or assembly 300 consists of two, legs or, floor engaging members 323A, 324 and 323B 324B designed to rest on a floor surface with a foot 325, 326 at one end of each floor engaging member resting against the base of a wall or skirting board. The floor engaging members are telescopically extendible as described above.

The term "foot" is used for parts 325 and 326 in FIG. 6 because this type of assembly is rather reminiscent of someone sitting on the floor with their arms and legs outstretched. In this stance the person's feet would contact the skirting board and their outstretched arms would contact the wall. It should therefore be understood that the face of the feet in this example do not contact the floor, other than at their side edges.

Pivotally connected to each floor engaging member by means of corner pieces 343A, 343B are arms wall engaging members 321A, 335A and 321B, 335B. The wall engaging members terminate at the wall end, distal from the corner pieces, in a wall plate 333A, 333B. The wall engaging members are also telescopically extendible.

The angle of the floor engaging members with respect to the wall engaging members is adjusted at the pivot point by means of fixings associated with the corner pieces 343A, 343B. The wall plates 333A, 333B could profitably be pivotally or adjustably attached to their arms as described above.

An anchor point 360 for a harness is provided on a linking member assembly 311A, 311C, 311D which links the two corner pieces 343A and 343B into a rigid structure.

This example therefore makes use of the same inventive concept as those described above, namely two arms and two feet joined by a corner portion and at least one linking member joining the opposing side portions.

FIG. 7 illustrates a pivotally mounted foot arrangement. Foot 426 is mounted to the side portion 423 by means of a pivot having pivot point 470. This arrangement is particularly useful because it allows the long foot 423 to be stowed out of the way against the side portion during transit and storage. This saves considerable space if there are a number of such safety assemblies to be stored or transported.

Figures 8, 8A, 8B, 8C, 8D:
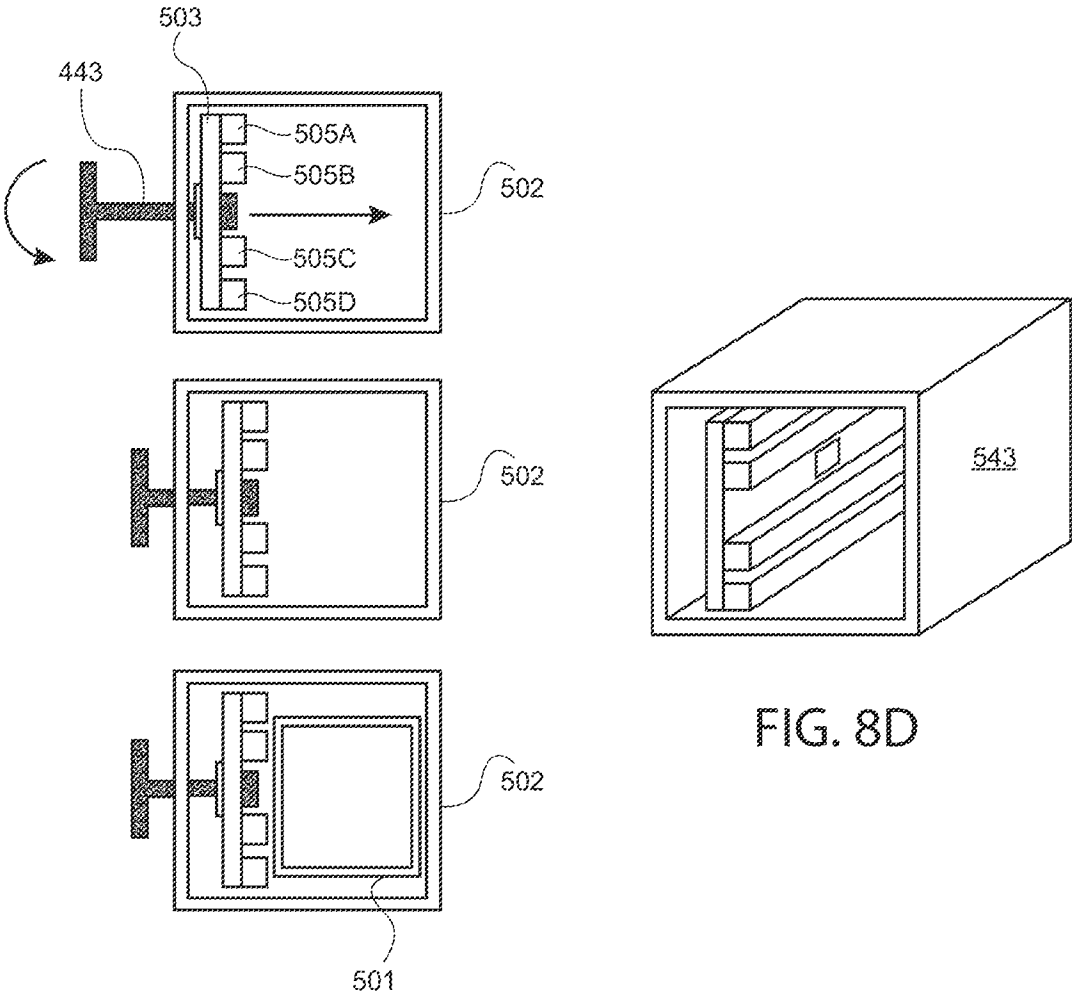
FIG. 8 illustrates one form of clamping arrangement inside telescopic sections.
Figure 9:
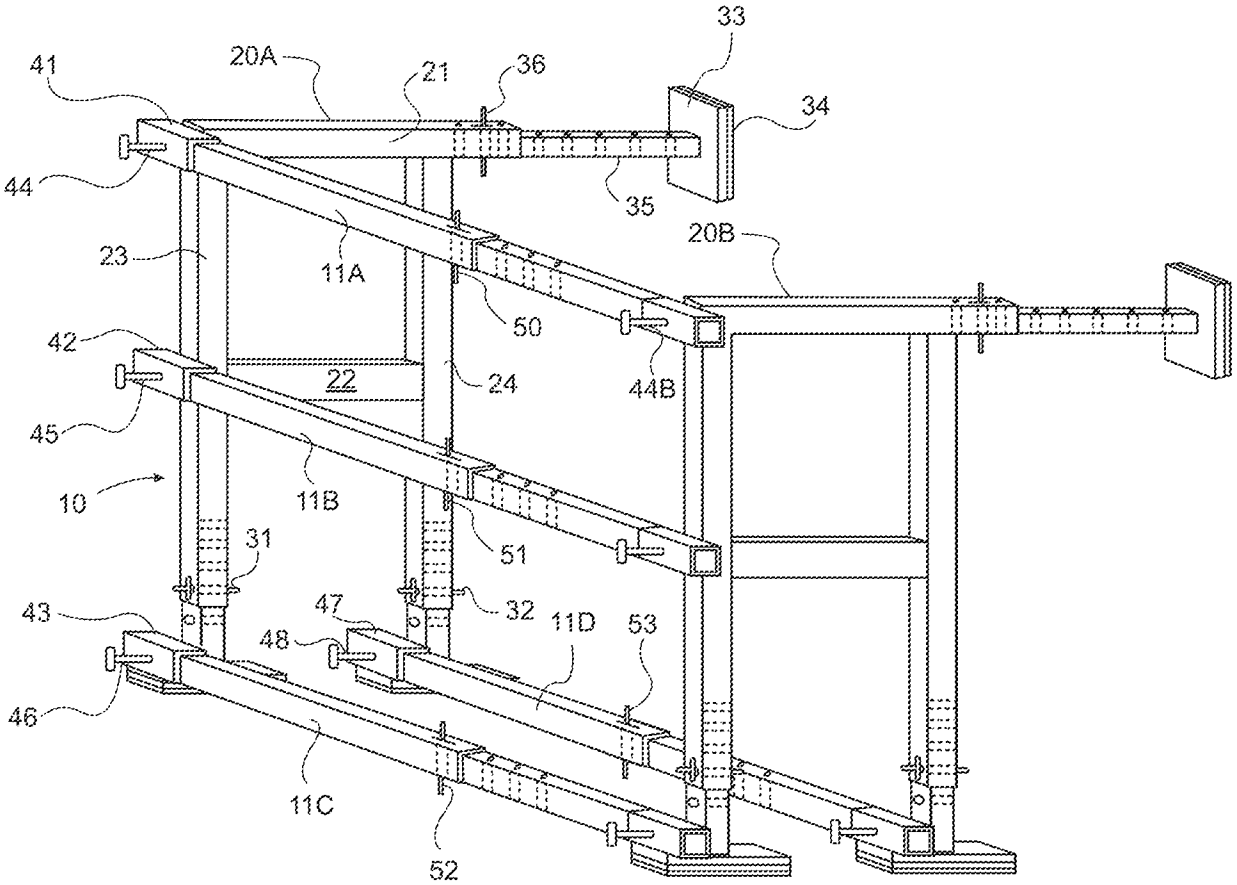
FIG. 9 illustrates the present invention in a free-standing position.

FIG. 8 illustrates a useful clamping mechanism for clamping one square box section 501 inside another box section 502 in the context of a securing-means such as 143A/B in FIG. 4, labelled here as 543. A clamping plate 503 is driven backwards and forwards across the inside of outer box section 502 by means of a screw threaded drive bolt 504. The load from the clamping plate is spread by four elongate bars 505A, 5056B 505C and 505D. The clamping plate and these bars are preferably formed from steel, such as mild steel, which ensure a firm grip is made on the inner box section. This arrangement ensures that wherever the inner box section 501 is located inside outer box section 502 it can be firmly clamped in position.

In this way a Velux® type window in a sloping wall can be safely removed and/or installed.

I claim:

1. A free-standing, demountable window safety configured to rest, in use, on the floor inside a room containing a window opening in a wall and against the wall containing the window while neither engaging with nor passing through the window opening, said assembly comprising:

at least two elongate feet configured to engage with the room floor;

a first arm and a second arm, an end of each of the first arm and the second arm being configured to engage with the room wall adjacent to but spaced away from the window opening;

side portions, each side portion respectively supporting the first arm and the second arm; and at least one linking member configured to link opposing side portions or opposing feet in a substantially rigid fashion.

2. A free-standing, demountable window safety assembly configured to rest, in use, on a floor inside a room containing a window opening in a wall and against the wall containing the window while neither engaging with nor passing through the window opening, said assembly comprising:

at least two feet configured to engage with the room floor;

at least a first arm and a second arm, an end of each of the first arm and the second arm being configured to engage with the wall adjacent to but spaced away from the window opening;

side portions, each being configured for respectively supporting the first arm and the second arm; and at least one linking member configured to link opposing side portions or opposing feet in a substantially rigid fashion, wherein the side portions respectively comprise a vertical-in-use portion and a horizontal-in-use portion, the horizontal-in-use portion comprising one of the two first and second arms.

3. The safety assembly according to claim 2, wherein the side portions further comprise a bracing member, bracing between the vertical-in-use portion and the horizontal-in-use portion.

4. A free-standing, demountable window safety assembly configured to rest, in use, on a floor inside a room containing a window opening in a wall and against the wall containing the window while neither engaging with nor passing through the window opening, said assembly comprising:

at least two feet configured to engage with the room floor;

at least a first arm and a second arm, an end of each of the first arm and the second arm being configured to engage with the wall adjacent to but spaced away from the window opening;

side portions, each being configured for respectively supporting the first arm and the second arm; and at least one linking member configured to link opposing side portions or opposing feet in a substantially rigid fashion, wherein the side portions are telescopic.

5. A free-standing, demountable window safety assembly configured to rest, in use, on a floor inside a room containing a window opening in a wall and against the wall containing the window while neither engaging with nor passing through the window opening, said assembly comprising:

at least two feet configured to engage with the room floor;

at least a first arm and a second arm, an end of each of the first arm and the second arm being configured to engage with the wall adjacent to but spaced away from the window opening;

side portions, each being configured for respectively supporting the first arm and the second arm; and at least one linking member configured to link opposing side portions or opposing feet in a substantially rigid fashion, further comprising a first wall pad and a second wall pad respectively located substantially at the ends of each of the first and second arms, the first and second wall pad being configured to contact the wall adjacent to the window opening in use.

6. The safety assembly according to claim 5, wherein the first and second wall pads are pivotally mounted with respect to their respective first and second arms, enabling the safety assembly to engage with a room wall that is not perpendicular to the room floor.

7. A free-standing, demountable window safety assembly configured to rest, in use, on a floor inside a room containing a window opening in a wall and against the wall containing the window while neither engaging with nor passing through the window opening, said assembly comprising:

at least two feet configured to engage with the room floor;

at least a first arm and a second arm, an end of each of the first arm and the second arm being configured to engage with the wall adjacent to but spaced away from the window opening;

side portions, each being configured for respectively supporting the first arm and the second arm; and at least one linking member configured to link opposing side portions or opposing feet in a substantially rigid fashion, wherein the feet respectively project along the floor in the direction of the first arm and the second arm such that each foot supports respectively a first of the at least two side portions and a second of the at least two side portions and the first of the at least two arms and the second of the at least two arms such that each of the at least two side portions is free-standing.

8. A free-standing, demountable window safety assembly configured to rest, in use, on a floor inside a room containing a window opening in a wall and against the wall containing the window while neither engaging with nor passing through the window opening, said assembly comprising:

at least two feet configured to engage with the room floor;

at least a first arm and a second arm, an end of each of the first arm and the second arm being configured to engage with the wall adjacent to but spaced away from the window opening;

side portions, each being configured for respectively supporting the first arm and the second arm; and at least one linking member configured to link opposing side portions or opposing feet in a substantially rigid fashion, wherein the feet are pivotally mounted with respect to their respective side portions.

9. A free-standing, demountable window safety assembly configured to rest, in use, on a floor inside a room containing a window opening and against a wall containing the window while neither engaging with nor passing through the window opening, said safety assembly comprising:

at least two floor engaging members;

at least two feet, one at an end of each floor engaging member;

at least two wall engaging members;

at least two wall plates, one at the end of each wall engaging member, the wall plates being configured so as to contact the wall adjacent to the window opening in use; and at least one linking member configured to link opposing floor engaging members;

wherein a respective wall engaging member is connected to a respective floor engaging member, at least one of the feet being configured to engage with the base of the wall containing the window when the assembly is in use, wherein the wall engaging members are pivotally connected to respective floor engaging members by corner pieces.

10. A free-standing, demountable window safety assembly configured to rest, in use, on a floor inside a room containing a window opening and against a wall containing the window while neither engaging with nor passing through the window opening, said safety assembly comprising:

at least two floor engaging members;

at least two feet, one at an end of each floor engaging member;

at least two wall engaging members;

at least two wall plates, one at the end of each wall engaging member, the wall plates being configured so as to contact the wall adjacent to the window opening in use; and at least one linking member configured to link opposing floor engaging members;

wherein a respective wall engaging member is connected to a respective floor engaging member, at least one of the feet being configured to engage with the base of the wall containing the window when the assembly is in use, further comprising a mounting member configured to connect a safety harness to the safety assembly.

11. The safety assembly according to claim 10, wherein the mounting member is associated with or attached to one of the at least one linking member.

12. A free-standing, demountable window safety assembly configured to rest, in use, on a floor inside a room containing a window opening and against a wall containing the window while neither engaging with nor passing through the window opening, said safety assembly comprising:

at least two floor engaging members;

at least two feet, one at an end of each floor engaging member;

at least two wall engaging members;

at least two wall plates, one at the end of each wall engaging member, the wall plates being configured so as to contact the wall adjacent to the window opening in use; and at least one linking member configured to link opposing floor engaging members;

wherein a respective wall engaging member is connected to a respective floor engaging member, at least one of the feet being configured to engage with the base of the wall containing the window when the assembly is in use, wherein the wall pads plates are pivotally connected with respect to a wall engaging member, enabling the safety assembly to engage with a sloping wall, sloping at a variety of angles to the perpendicular.

13. A free-standing, demountable window safety assembly configured to rest, in use, on a floor inside a room containing a window opening in a wall and against the wall containing the window while neither engaging with nor passing through the window opening, said assembly comprising:

at least two feet configured to engage with the room floor;

a first arm and a second arm, an end of each of the first arm and the second arm being configured to engage with the room wall adjacent to but spaced away from the window opening;

side portions, each side portion of the side portions respectively supporting the first arm and the second arm; and at least one linking member configured to link opposing side portions or opposing feet in a substantially rigid fashion and laterally adjustably connectable at distal ends thereof to the opposing side portions.

14. The safety assembly according to claim 13, wherein the at least one linking member is clamped to opposing side portions to set a lateral extension of the at least one linking member.

15. A free-standing, demountable window safety assembly configured to rest, in use, on a floor inside a room containing a window opening in a wall and against the wall containing the window while neither engaging with nor passing through the window opening, said assembly comprising:

at least two feet configured to engage with the room floor;

at least a first arm and a second arm, an end of each of the first arm and the second arm being configured to engage with the wall adjacent to but spaced away from the window opening;

side portions, each being configured for respectively supporting the first arm and the second arm; and at least one linking member configured to link opposing side portions or opposing feet in a substantially rigid fashion, wherein the at least one linking member links opposing feet and is telescopic.

16. The safety assembly according to claim 15, wherein the at least one linking member comprises a first section slidable within a second section and held in place by a pin.

17. A free-standing, demountable window safety assembly configured to rest, in use, on a floor inside a room containing a window opening in a wall and against the wall containing the window while neither engaging with nor passing through the window opening, said assembly comprising:

at least two feet configured to engage with the room floor;

at least a first arm and a second arm, an end of each of the first arm and the second arm being configured to engage with the wall adjacent to but spaced away from the window opening;

side portions, each being configured for respectively supporting the first arm and the second arm; and at least one linking member configured to link opposing side portions or opposing feet in a substantially rigid fashion, wherein the at least one linking member comprises a lower at least one linking member secured adjacent the at least two feet.

18. A free-standing, demountable window safety assembly configured to rest, in use, on a floor inside a room containing a window opening in a wall and against the wall containing the window while neither engaging with nor passing through the window opening, said assembly comprising:

at least two feet configured to engage with the room floor;

at least a first arm and a second arm, an end of each of the first arm and the second arm being configured to engage with the wall adjacent to but spaced away from the window opening;

side portions, each being configured for respectively supporting the first arm and the second arm; and at least one linking member configured to link opposing side portions or opposing feet in a substantially rigid fashion, wherein each of the at least two feet respectively project along the floor in the direction of the first arm and the second arm.

19. A free-standing, demountable window safety assembly configured to rest, in use, on a floor inside a room containing a window opening in a wall and against the wall containing the window while neither engaging with nor passing through the window opening, said assembly comprising:

at least two feet configured to engage with the room floor;

at least a first arm and a second arm, an end of each of the first arm and the second arm being configured to engage with the wall adjacent to but spaced away from the window opening;

side portions, each being configured for respectively supporting the first arm and the second arm; and at least one linking member configured to link opposing side portions or opposing feet in a substantially rigid fashion, wherein each of the at least two feet is respectively coupled to each of the side portions at a respective point of coupling, each of the points of coupling being off-center with respect to a respective upper surface of the each of the at least two feet.

* * * * *